US007387407B2

(12) United States Patent
Tseng

(10) Patent No.: US 7,387,407 B2
(45) Date of Patent: Jun. 17, 2008

(54) STRING OF LIGHT WITH MATCHED LIGHT BULBS AND SOCKETS

(76) Inventor: Wei-Jen Tseng, 5F, No. 10, Lane 23, Tungshan St., Hsinchu City (TW)

( * ) Notice: Subject to any disclaimer, the term of this patent is extended or adjusted under 35 U.S.C. 154(b) by 9 days.

(21) Appl. No.: 11/537,949

(22) Filed: Oct. 2, 2006

(65) Prior Publication Data

US 2008/0080183 A1 Apr. 3, 2008

(51) Int. Cl.
*F21V 21/00* (2006.01)
*H01R 13/40* (2006.01)

(52) U.S. Cl. ..... 362/249; 362/252; 439/602

(58) Field of Classification Search ..... 362/249, 362/252, 226, 391, 227; 439/226, 227, 602
See application file for complete search history.

(56) References Cited

U.S. PATENT DOCUMENTS 4,778,409 A * 10/1988 Maddock ..... 439/602
7,178,961 B2 * 2/2007 Janning ..... 362/565

* cited by examiner

*Primary Examiner*—John A Ward
(74) *Attorney, Agent, or Firm*—patenttm.us

(57) ABSTRACT

A string of light uniquely matches light bulbs to sockets based on a structure. Each light bulb has a bulb and a base. The bulb has a bottom, and the base is connected to the bottom of the bulb and has a thread and a central contact protruding coaxially from the base. Each socket has a recess to hold the light bulb and has an inner sidewall, a thread formed on the inner sidewall, a resilient contact mounted longitudinally on the inner wall and abutting the outer surface of the base and an central contact in the recess and selectively abutting the central contact of the light bulb depending on the structure of the light bulb and the socket.

7 Claims, 10 Drawing Sheets

STRING OF LIGHT WITH MATCHED LIGHT BULBS AND SOCKETS

BACKGROUND OF THE INVENTION

1. Field of Invention

The present invention relates to a string of light, and more particularly to a string of light with matched light bulbs and sockets so particular light bulbs with a particular visual effect can only be mounted in corresponding sockets.

2. Description of the Related Art

People use ornaments to improve the ambiance of festivals and holidays, but conventional ornaments are not conspicuous enough to attract people. Consequently, people usually mount strings of lights inside or outside ornaments to make the ornament shine. The ornaments are normally placed at entrances to houses, restaurants and exhibitions as decorations. Particularly, the strings of lights usually have standard lamps and non-standard lamps (i.e. blinking lamps) to provide a special visual effect.

To create a blinking visual effect, a blinking lamp comprises a circuit, a blinking bulb and a socket. The blinking bulb has a thermally sensitive element that open or closes the electrical illumination circuit through the blinking bulb when the thermally sensitive element is in a corresponding "hot" or "cold" state. Generally, standard lamps and blinking lamps are arranged to form a specific configuration or to produce a specific effect, so standard bulbs and blinking bulbs are mounted in specific positions. A thermal switch is also used to switch current between a flasher bulb and a low resistance bypass circuit. However, strings of flasher bulbs must have a certain number of standard bulbs to ensure a resistance is always in the line to prevent an over current situation. However, the standard bulbs are often replaced with flasher bulbs to enhance the visual effect.

However, conventional sockets for standard bulbs or blinking bulbs are the same and techniques for connecting sockets and different types of light bulbs are also the same. Thus, to arrange the light bulbs in appropriate positions takes time. Moreover, if one light bulb breaks, a user cannot determine what kind of light bulb should be bought to replace the broken light bulb. If light bulbs are put in incorrect positions, the specific configuration or the specific effect cannot be achieved.

To overcome the shortcomings, the present invention provides a string of light with a matched light bulb and socket to mitigate or obviate the aforementioned problem.

SUMMARY OF THE INVENTION

The primary objective of the present invention is to provide a string of light with a matched light bulb and socket so a specific light bulb can only be mounted in a corresponding socket to produce a specific effect.

To achieve the objective, the string of light has matching light bulbs and sockets. Each light bulb has a bulb and a base. The bulb has a bottom. The base is attached to the bottom of the bulb and has an outer surface, a bottom, a thread and a central contact. The outer surface is cylindrical and conductive and is an electrical contact. The thread is formed on the outer surface. The central contact is formed coaxially on and protrudes from the bottom of the base and has a distal end. Each socket has a recess, a resilient contact and a central contact. The recess is cylindrical, holds a corresponding light bulb and has an open top, a closed bottom, an inner sidewall and a thread. The thread is formed on the inner sidewall of the recess and corresponds to the thread on the outer surface of the base of the light bulb. The resilient contact is mounted longitudinally on the inner sidewall and abuts the outer surface of the base of the light bulb to allow electricity to flow. The central contact is mounted coaxially on the bottom of the recess and abuts the distal end of the central contact on the base of the light bulb to allow electricity to flow. The light bulb corresponds uniquely to particular socket configuration, so each light bulb can be mounted only in a specific socket.

Other objectives, advantages and novel features of the invention will become more apparent from the following detailed description when taken in conjunction with the accompanying drawings.

DETAILED DESCRIPTION OF THE INVENTION

Figure 1:
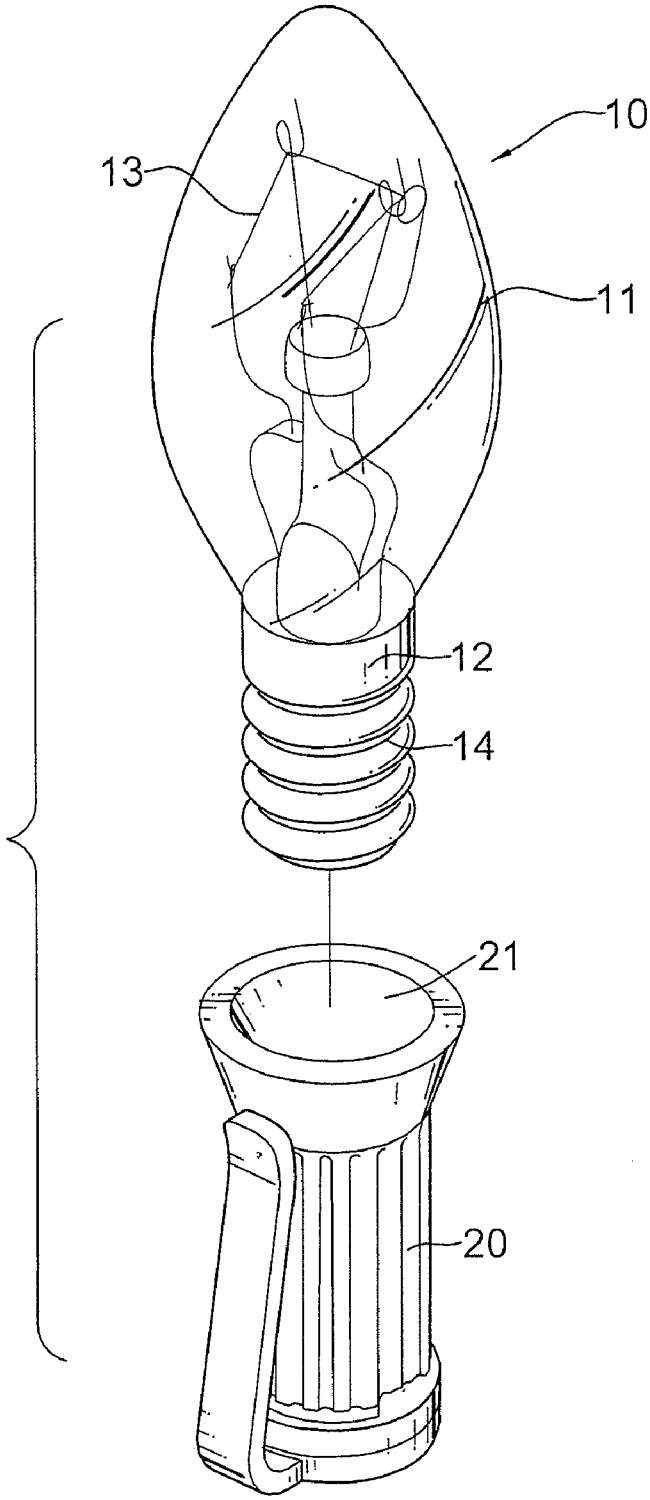
FIG. 1 is a partially exploded perspective view of a light bulb and a socket of a string of light in accordance with the present invention.
Figure 2:
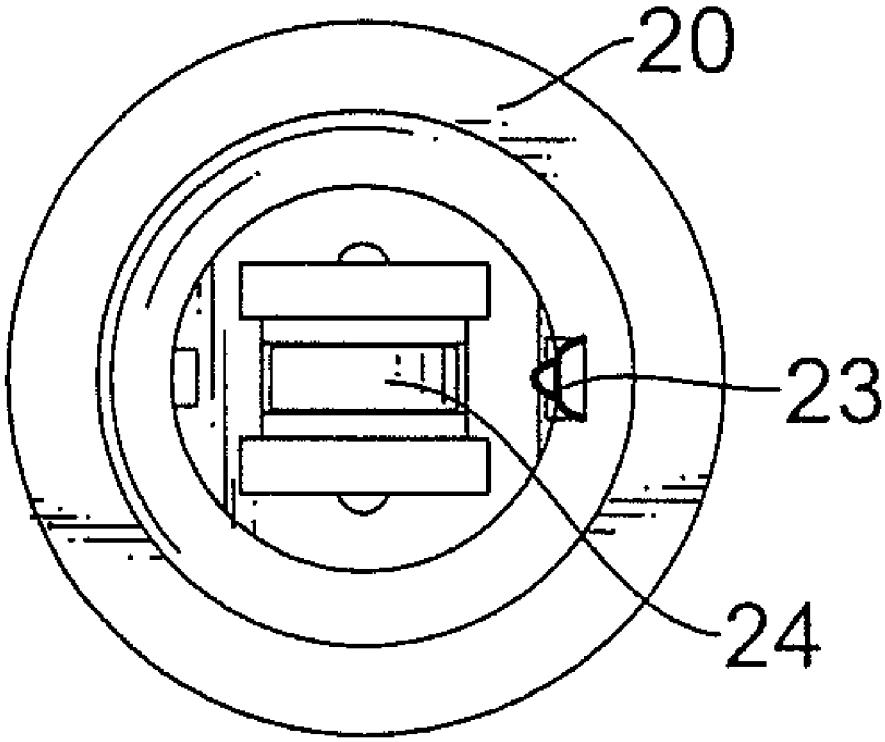
FIG. 2 is a top view of a socket of the light bulb and the socket of the string of light in FIG. 1.
Figure 3:
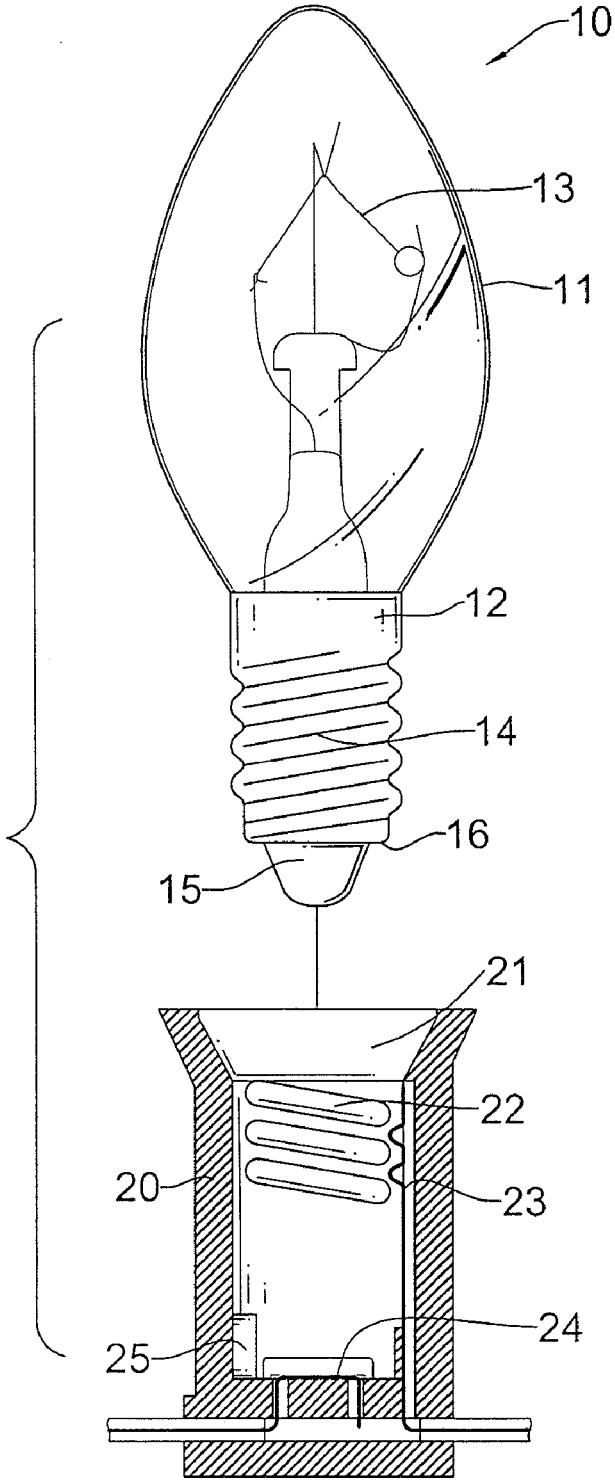
FIG. 3 is a partially exploded side view in partial section of a first variant of a first embodiment of a light bulb and a socket of a string of light in accordance with the present invention.

With reference to FIGS. 1, 3, 4, 6, 8 to 10, a string of light in accordance with the present invention comprises a string (30) and multiple lamp assemblies (A, B).

The string (30) has two ends and a plug (31). The plug (31) is mounted in one end of the string (30).

The lamp assemblies (A, B) are mounted on the string (30) are classified into A-typed lamp assemblies (A) and B-typed assemblies (B) and each lamp assembly (A, B) has a light bulb (10, 10A, 10B, 10C) and a socket (20, 20A, 20B, 20C, 20D).

The light bulbs (10, 10A, 10B, 10C, 10D) are classified into A-typed light bulbs (10, 10A, 10B, 10C, 10D) and B-typed light bulbs (10, 10A, 10B, 10C, 10D) that may be standard light bulbs being non-flashing or blinking light bulbs. Each light bulb (10, 10A, 10B, 10C, 10D) has a bulb (11) and a base (12, 12A, 12B, 12C, 12D).

The bulb (11) has a bottom, an inner chamber and illumination elements. The illumination elements such as a tungsten filament (13) are mounted in the inner chamber.

Figure 4:
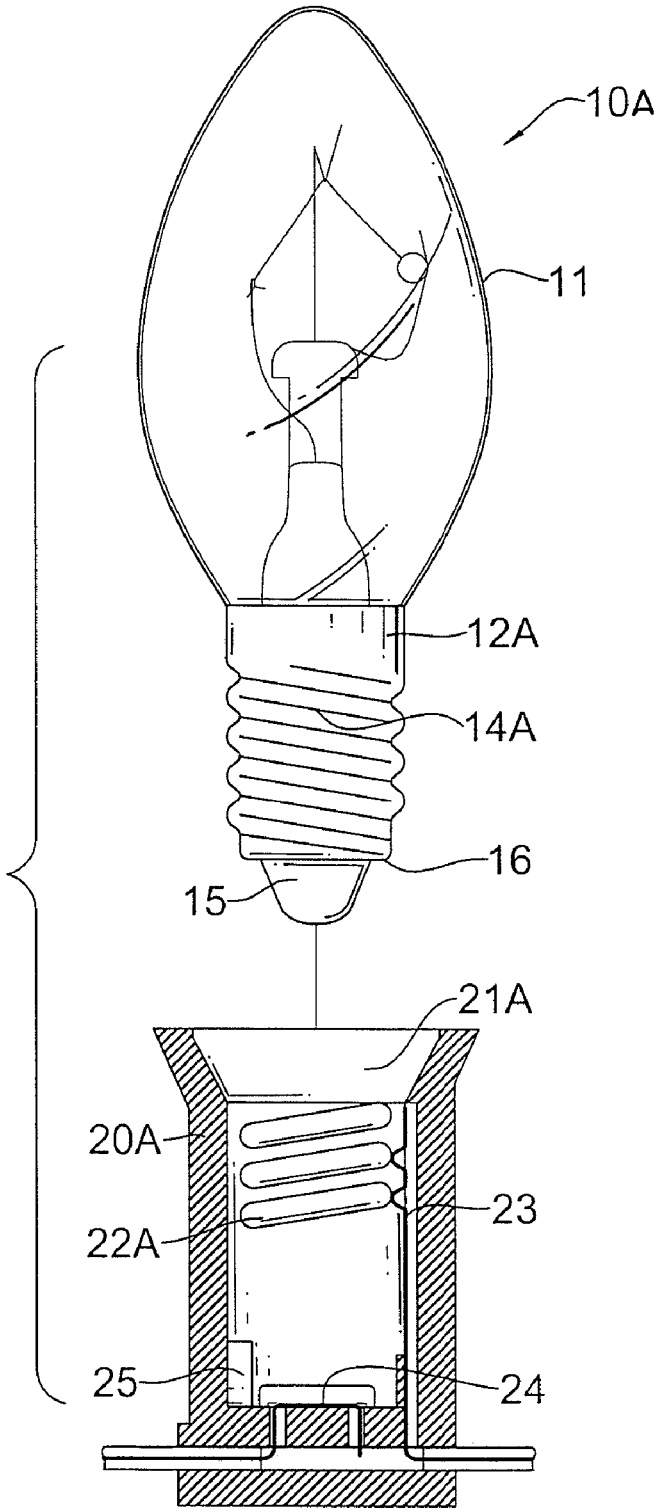
FIG. 4 is a partially exploded side view in partial section of a first variant of a second embodiment of a light bulb and a socket of a string of light in accordance with the present invention.
Figure 5:
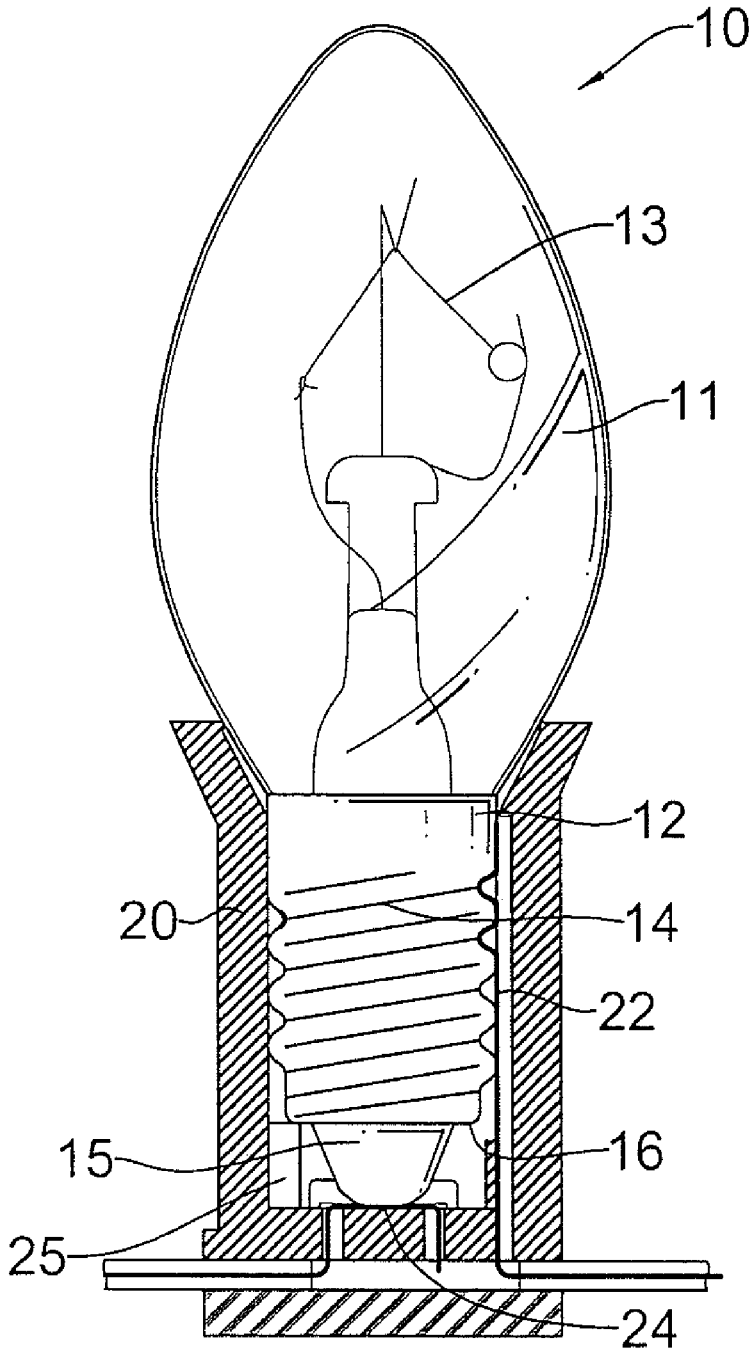
FIG. 5 is a side view in partial section of the light bulb and the socket of the string of light in FIG. 3.
Figure 6:
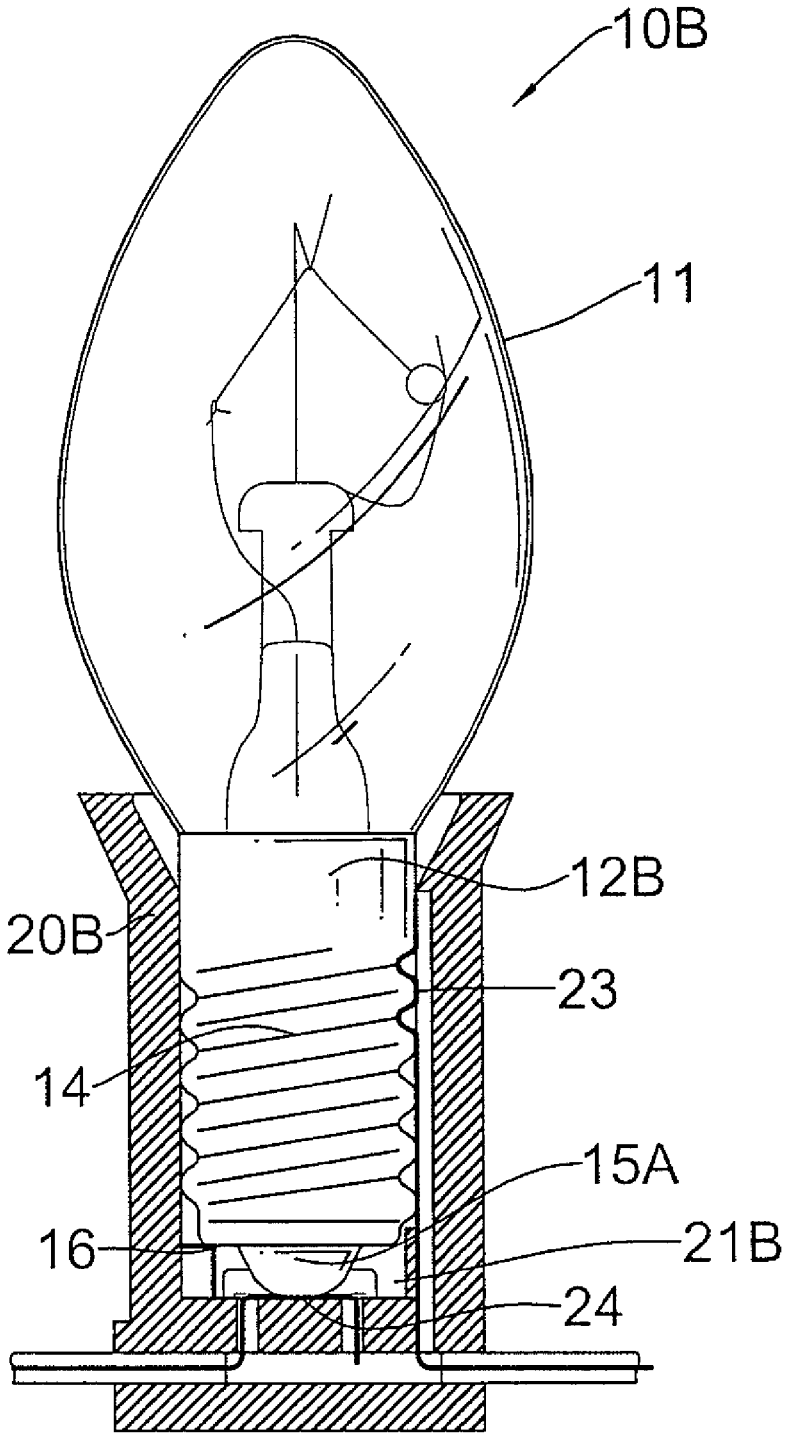
FIG. 6 is a side view in partial section of a second variant of a second embodiment of a light bulb and a socket of a string of light in accordance with the present invention.

The base (12, 12A, 12B, 12C, 12D) is attached to the bottom of the bulb (11) and has a dimension, an outer surface, a bottom (16), a thread (14, 14A) and a central contact (15, 15A). The dimension in a fourth variant of a first embodiment of the string of light in accordance with the present invention is larger than the dimension in a fourth variant of a second embodiment of the string of light in accordance with the present invention. The outer surface is cylindrical and conductive and is an electrical contact for the light bulb (10, 10A, 10B, 10C, 10D). The thread (14, 14A) is formed on the outer surface of the base (12), has a thread pitch, may be a right hand thread (14) or a left hand thread (14A) and may be a standard, fine or course thread. The thread pitch of the fine thread is smaller than the thread pitch of the standard thread. The thread pitch of the standard thread is smaller than the thread pitch of the course thread. With further reference to FIG. 5, the thread (14) in the first embodiment of the string of light in accordance with the present invention has a right hand thread. The thread (14A) in the second embodiment of the string of light in accordance with the present invention has a left hand thread as shown in FIG. 4. The central contact (15, 15A) is formed coaxially on and protrudes from the bottom (16) of the base (12, 12A, 12B, 12C, 12D) and has a length and a distal end. The length of the central contact (15A) in a second variant of the first and second embodiment in accordance with the present invention is significantly shorter than the length of the central contact (15) in the first and third variants in the first and second embodiments in accordance with the present invention and is used on light bulbs (10B) that blink. The central contact (15) in the first and third variants in the first and second embodiment is used on light bulbs (10, 10A, 10C, 10D) that are standard light bulbs.

The sockets (20, 20A, 20B, 20C, 20D) are mounted on the string (30), are classified into A-typed sockets (20, 20A, 20B, 20C, 20D) and B-typed sockets (20, 20A, 20B, 20C, 20D). The A-typed sockets (20, 20A, 20B, 20C, 20D) respectively and exclusively hold the A-typed light bulbs (10, 10A, 10B, 10C, 10D). The B-typed sockets (20, 20A, 20B, 20C, 20D) respectively and exclusively hold the B-typed light bulbs (10, 10A, 10B, 10C, 10D). Each socket (20, 20A, 20B, 20C, 20D) has a recess (21, 21A, 21B, 21C), a resilient contact (23), a central contact (24) and an optional positive stop (25).

The recess (21, 21A, 21B, 21C) is cylindrical, holds a corresponding light bulb (10, 10A, 10B, 10C, 10D) and has a dimension, an open top, a closed bottom, an inner sidewall and a thread (22, 22A, 22B).

The dimension corresponds to the dimension of the base (12, 12A, 12B, 12C, 12D) of the light bulb (10, 10A, 10B, 10C, 10D). The thread (22, 22A, 22B) is formed on the inner sidewall of the recess (21, 21A, 21B, 21C) and corresponds to the thread (14, 14A) on the outer surface of the base (12, 12A, 12B, 12C, 12D) of the light bulb (10, 10A, 10B, 10C, 10D).

The resilient contact (23) is mounted longitudinally on the inner sidewall and abuts the outer surface of the base (12, 12A, 12B, 12C, 12D) of the light bulb (10, 10A, 10B, 10C, 10D) to allow electricity to flow.

The central contact (24) is mounted coaxially on the bottom of the recess (21) and abuts the distal end of the central contact (15) on the base (12, 12A, 12B, 12C, 12D) of the light bulb (10, 10A, 10B, 10C, 10D) to allow electricity to flow.

Figure 7:
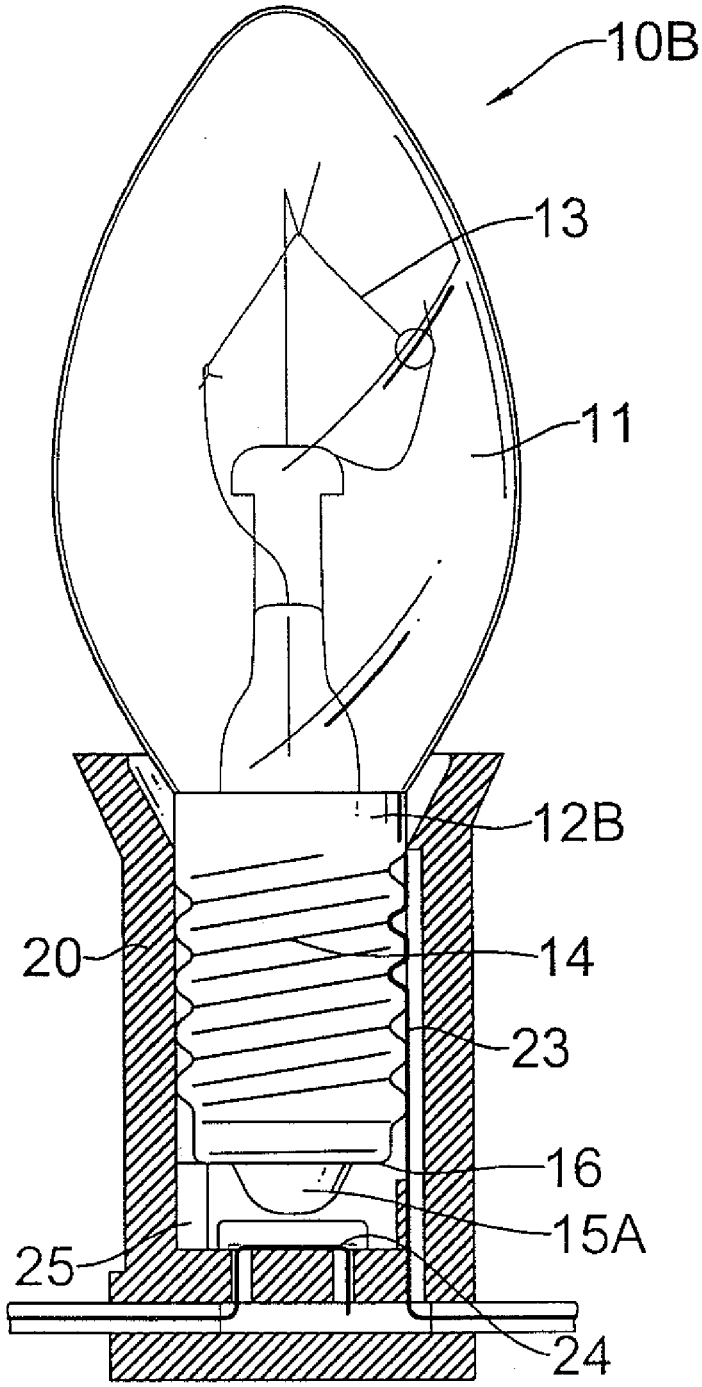
FIG. 7 is an operational side view in partial section of a second variant, first embodiment bulb in FIG. 6 mounted in a first variant, first embodiment of a string of light socket in FIG. 3.
Figure 8:
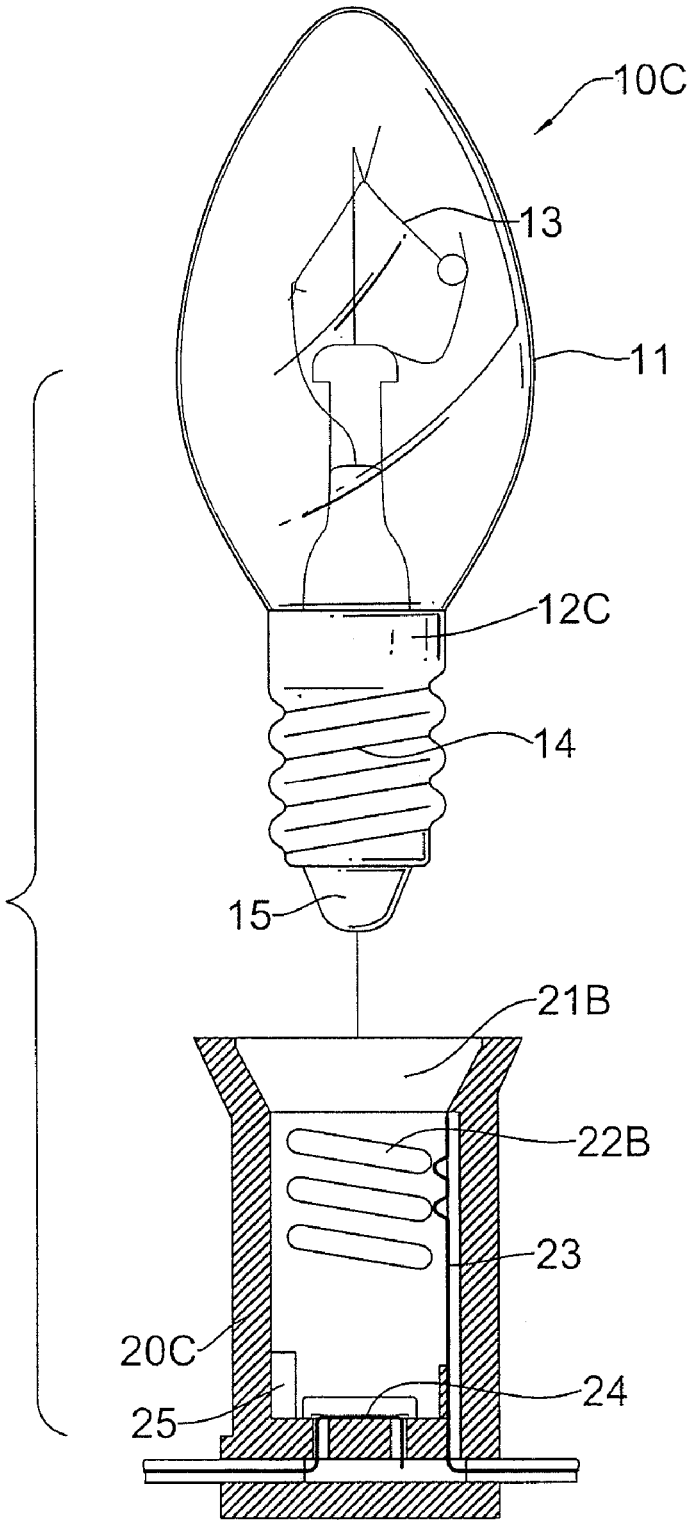
FIG. 8 is an exploded side view in partial section of a third variant of a first embodiment of a light bulb and a socket of a string of light in accordance with the present invention.
Figure 9:
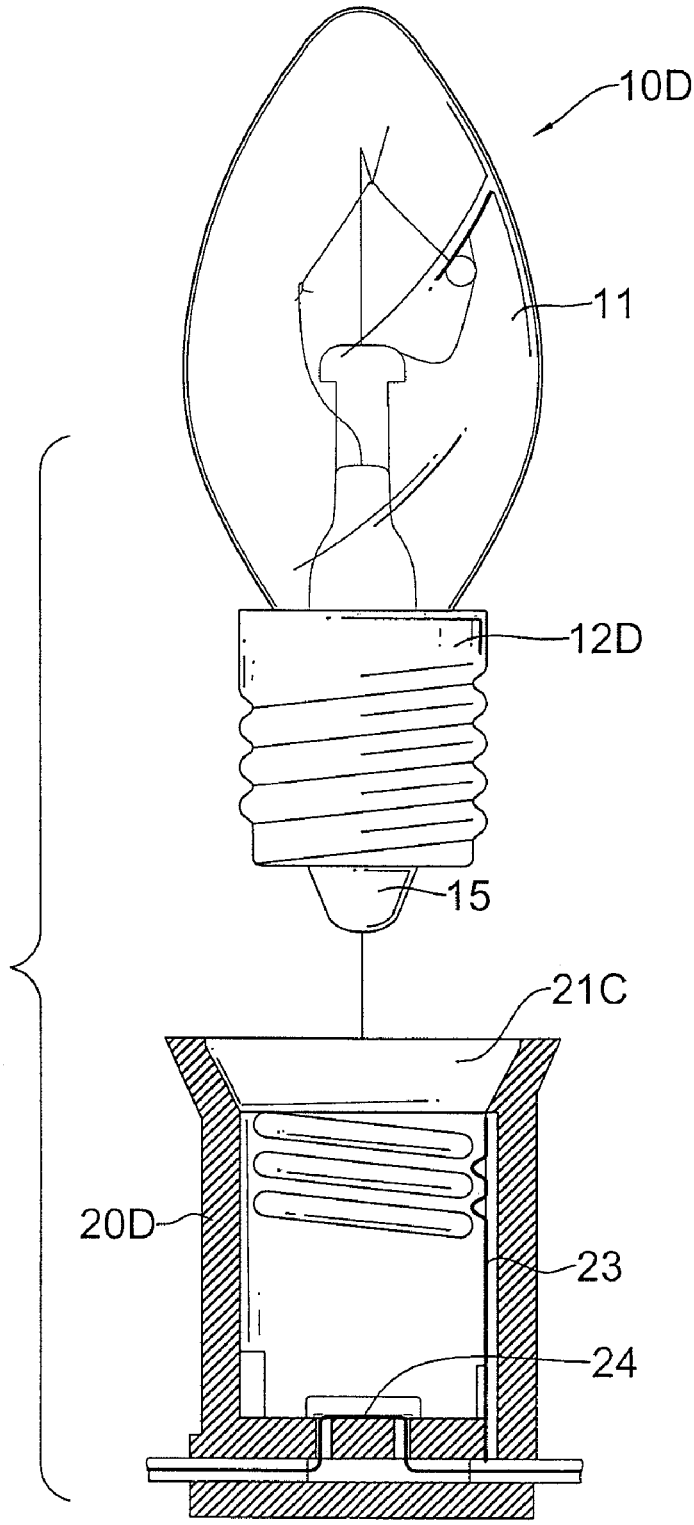
FIG. 9 is an exploded side view in partial section of a fourth variant of the first embodiment of a light bulb and a socket of a string of light in accordance with the present invention.
Figure 10:
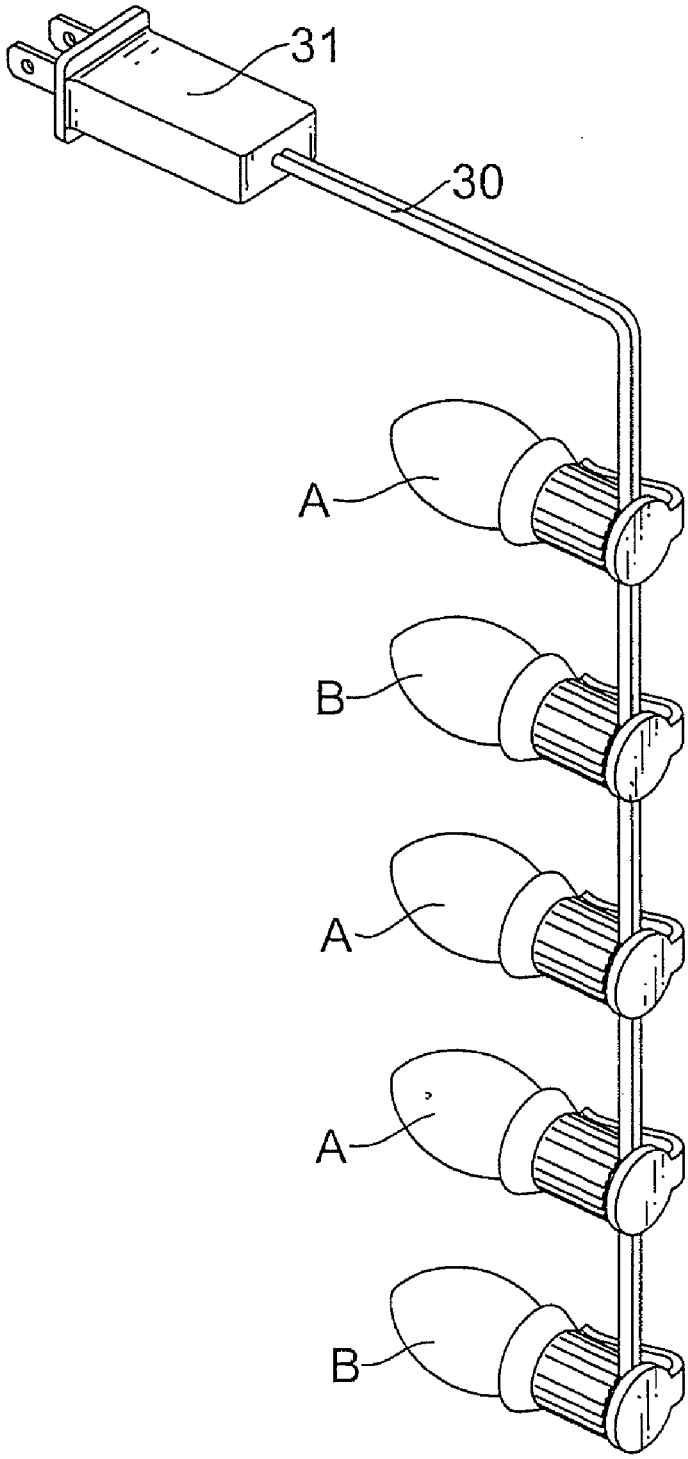
FIG. 10 is a perspective view of a string of light in accordance with the present invention.

The positive stop (25) is mounted on the bottom of the recess (21) adjacent to the inner sidewall of the recess (21, 21A, 21C) and has a length and a distal end. In the second variant of the first and second embodiments, with reference to FIG. 6, the socket has no positive stop (25) so the shorter central contact (15A) in the second variants of the first and second embodiments of the string of light will abut the central contact (24) in the recess (21B, 21C). With further reference to FIG. 7 illustrating an incorrect installation of the lamp assembly (A, B), the distal end of the positive stop (25) of the socket (20, 20A, 20C, 20D) in a first or third variant of the first and second embodiments abuts the bottom (16) of the base (12B) of the light bulb (10B). Therefore, the central contact (15A) on the base (12B) does not contact the central contact (24) in the recess (21, 21B). When the A-typed lamp assemblies (A) and the B-typed lamp assemblies (B) are implemented respectively with two different variants of the embodiment, the A-typed socket (20, 20A, 20B, 20C, 20D) is incapable of holding the B-typed light bulb (10, 10A, 10B, 10C, 10D). Also, the B-typed socket (20, 20A, 20B, 20C, 20D) is incapable of holding the A-typed light bulb (10, 10A, 10B, 10C, 10D).

The string of light as described has the following advantages. Because the light bulbs (10, 10A, 10B, 10C, 10D) and sockets (20, 20A, 20B, 20C, 20D) are uniquely paired in the string of light as described, determining what type of bulb (10, 10A, 10B, 10C, 10D) to buy to replace a burned out light bulb (10, 10A, 10B, 10C, 10D) is easily determined by the specific socket (20, 20A, 20B, 20C, 20D). Furthermore, standard bulbs in strings of flasher bulbs cannot be replaced with flasher bulbs when lamp assemblies as described are used in the string of bulbs.

Even though numerous characteristics and advantages of the present invention have been set forth in the foregoing description, together with details of the structure and function of the invention, the disclosure is illustrative only. Changes may be made in detail, especially in matters of shape, size and arrangement of parts within the principles of the invention to the full extent indicated by the broad general meaning of the terms in which the appended claims are expressed.

What is claimed is:

1. A string of light comprising:

a string;

multiple A-typed light bulbs and each A-typed light bulb having a bulb having a bottom;

an inner chamber; and illumination elements mounted in the inner chamber; and a base being attached to the bottom of the bulb and having an outer surface being cylindrical and conductive and being an electrical contact for the light bulb;

a bottom;

a thread being formed on the outer surface of the base and having a thread pitch; and a central contact being formed coaxially on and protruding from the bottom of the base and having a length and a distal end;

multiple A-typed sockets mounted on the string, exclusively holding the A-typed light bulbs and each A-typed socket having a recess being cylindrical, holding a corresponding A-typed light bulb and having an open top;
a closed bottom;
an inner sidewall; and
a thread being formed on the inner sidewall of the recess, having a thread pitch and corresponding to the thread on the outer surface of the base of the corresponding A-typed light bulb;
a resilient contact being mounted longitudinally on the inner sidewall and abutting the outer surface of the base of the corresponding A-typed light bulb to allow electricity to flow; and
a central contact being mounted coaxially on the bottom of the recess and abutting the distal end of the central contact of the bottom of the base of the corresponding A-typed light bulb to allow electricity to flow;
multiple B-typed light bulbs and each B-typed light bulb having
a bulb having
a bottom;
an inner chamber; and
illumination elements mounted in the inner chamber; and
a base being attached to the bottom of the bulb and having
an outer surface being cylindrical and conductive and being an electrical contact for the light bulb;
a bottom;
a thread being formed on the outer surface of the base and having a thread pitch; and
a central contact being formed coaxially on and protruding from the bottom of the base and having a length and a distal end;
multiple B-typed sockets mounted on the string, exclusively holding the B-typed light bulbs and each B-typed socket having
a recess being cylindrical, holding a corresponding B-typed light bulb and having
an open top;
a closed bottom;
an inner sidewall; and
a thread being formed on the inner sidewall of the recess, having a thread pitch and corresponding to the thread on the outer surface of the base of the corresponding B-typed light bulb;
a resilient contact being mounted longitudinally on the inner sidewall and abutting the outer surface of the base of the corresponding B-typed light bulb to allow electricity to flow; and
a central contact being mounted coaxially on the bottom of the recess and abutting the distal end of the central contact of the bottom of the base of the corresponding B-typed light bulb to allow electricity to flow;
wherein the threads on the base of the bulb of each A-typed light bulb and in the recess of the A-typed socket are right hand threads and the threads on the base of the bulb of each B-typed light bulb and in the recess of the B-typed socket are a left hand threads.

2. A string of light comprising:
a string;
multiple A-typed light bulbs and each A-typed light bulb having
a bulb having
a bottom;
an inner chamber
illumination elements mounted in the inner chamber; and
a base being attached to the bottom of the bulb and having
an outer surface being cylindrical and conductive and being an electrical contact for the light bulb;
a bottom;
a thread being formed on the outer surface of the base and having a thread pitch; and
a central contact being formed coaxially on and protruding from the bottom of the base and having a length and a distal end;
multiple A-typed sockets mounted on the string, exclusively holding the A-typed light bulbs and each A-typed socket having
a recess being cylindrical, holding a corresponding A-typed light bulb and having
an open top;
a closed bottom;
an inner sidewall; and
a thread being formed on the inner sidewall of the recess, having a thread pitch and corresponding to the thread on the outer surface of the base of the corresponding A-typed light bulb;
a resilient contact being mounted longitudinally on the inner sidewall and abutting the outer surface of the base of the corresponding A-typed light bulb to allow electricity to flow; and
a central contact being mounted coaxially on the bottom of the recess and abutting the distal end of the central contact of the bottom of the base of the corresponding A-typed light bulb to allow electricity to flow;
multiple B-typed light bulbs and each B-typed light bulb having
a bulb having
a bottom;
an inner chamber; and
illumination elements mounted in the inner chamber; and
a base being attached to the bottom of the bulb and having
an outer surface being cylindrical and conductive and being an electrical contact for the light bulb;
a bottom;
a thread being formed on the outer surface of the base and having a thread pitch; and
a central contact being formed coaxially on and protruding from the bottom of the base and having a length and a distal end;
multiple B-typed sockets mounted on the string, exclusively holding the B-typed light bulbs and each B-typed socket having
a recess being cylindrical, holding a corresponding B-typed light bulb and having
an open top;
a closed bottom;
an inner sidewall; and
a thread being formed on the inner sidewall of the recess, having a thread pitch and corresponding to the thread on the outer surface of the base of the corresponding B-typed light bulb;
a resilient contact being mounted longitudinally on the inner sidewall and abutting the outer surface of the base of the corresponding B-typed light bulb to allow electricity to flow; and a central contact being mounted coaxially on the bottom of the recess and abutting the distal end of the central contact of the bottom of the base of the corresponding B-typed light bulb to allow electricity to flow;

wherein the threads on the base of each bulb of A-typed light bulb and in the recess of the A-typed socket are a left hand thread and the threads on the base of the bulb of each B-typed light bulb and in the recess of the B-typed socket are right hand threads.

3. A string of light comprising:

a string;

multiple A-typed light bulbs and each A-typed light bulb having a bulb having a bottom;

an inner chamber illumination elements mounted in the inner chamber; and a base being attached to the bottom of the bulb and having an outer surface being cylindrical and conductive and being an electrical contact for the light bulb;

a bottom;

a thread being formed on the outer surface of the base and having a thread pitch; and a central contact being formed coaxially on and protruding from the bottom of the base and having a length and a distal end;

multiple A-typed sockets mounted on the string, exclusively holding the A-typed light bulbs and each A-typed socket having a recess being cylindrical, holding a corresponding A-typed light bulb and having an open top;

a closed bottom;

an inner sidewall; and a thread being formed on the inner sidewall of the recess, having a thread pitch and corresponding to the thread on the outer surface of the base of the corresponding A-typed light bulb;

a resilient contact being mounted longitudinally on the inner sidewall and abutting the outer surface of the base of the corresponding A-typed light bulb to allow electricity to flow; and a central contact being mounted coaxially on the bottom of the recess and abutting the distal end of the central contact of the bottom of the base of the corresponding A-typed light bulb to allow electricity to flow;

multiple B-typed light bulbs and each B-typed light bulb having a bulb having a bottom;

an inner chamber illumination elements mounted in the inner chamber; and a base being attached to the bottom of the bulb and having an outer surface being cylindrical and conductive and being an electrical contact for the light bulb;

a bottom;

a thread being formed on the outer surface of the base and having a thread pitch; and a central contact being formed coaxially on and protruding from the bottom of the base and having a length and a distal end;

multiple B-typed sockets mounted on the string, exclusively holding the B-typed light bulbs and each B-typed socket having a recess being cylindrical, holding a corresponding B-typed light bulb and having an open top;

a closed bottom;

an inner sidewall; and a thread being formed on the inner sidewall of the recess, having a thread pitch and corresponding to the thread on the outer surface of the base of the corresponding B-typed light bulb;

a resilient contact being mounted longitudinally on the inner sidewall and abutting the outer surface of the base of the corresponding B-typed light bulb to allow electricity to flow; and a central contact being mounted coaxially on the bottom of the recess and abutting the distal end of the central contact of the bottom of the base of the corresponding B-typed light bulb to allow electricity to flow;

wherein the thread pitches of the threads on the base of the bulb of each A-typed light bulb and in the recess of the A-typed socket are smaller than the thread pitches of the thread on the base of the bulb of each B-typed light bulb and in the recess of the B-typed socket.

4. A string of light comprising:

a string;

multiple A-typed light bulbs and each A-typed light bulb having a bulb having a bottom;

an inner chamber illumination elements mounted in the inner chamber; and a base being attached to the bottom of the bulb and having an outer surface being cylindrical and conductive and being an electrical contact for the light bulb;

a bottom;

a thread being formed on the outer surface of the base and having a thread pitch; and a central contact being formed coaxially on and protruding from the bottom of the base and having a length and a distal end;

multiple A-typed sockets mounted on the string, exclusively holding the A-typed light bulbs and each A-typed socket having a recess being cylindrical, holding a corresponding A-typed light bulb and having an open top;

a closed bottom;

an inner sidewall; and a thread being formed on the inner sidewall of the recess, having a thread pitch and corresponding to the thread on the outer surface of the base of the corresponding A-typed light bulb;

a resilient contact being mounted longitudinally on the inner sidewall and abutting the outer surface of the base of the corresponding A-typed light bulb to allow electricity to flow; and a central contact being mounted coaxially on the bottom of the recess and abutting the distal end of the central contact of the bottom of the base of the corresponding A-typed light bulb to allow electricity to flow;

multiple B-typed light bulbs and each B-typed light bulb having
a bulb having
a bottom;
an inner chamber; and
illumination elements mounted in the inner chamber; and
a base being attached to the bottom of the bulb and having
an outer surface being cylindrical and conductive and being an electrical contact for the light bulb;
a bottom;
a thread being formed on the outer surface of the base and having a thread pitch; and
a central contact being formed coaxially on and protruding from the bottom of the base and having a length and a distal end;
multiple B-typed sockets mounted on the string, exclusively holding the B-typed light bulbs and each B-typed socket having
a recess being cylindrical, holding a corresponding B-typed light bulb and having
an open top;
a closed bottom;
an inner sidewall; and
a thread being formed on the inner sidewall of the recess, having a thread pitch and corresponding to the thread on the outer surface of the base of the corresponding B-typed light bulb;
a resilient contact being mounted longitudinally on the inner sidewall and abutting the outer surface of the base of the corresponding B-typed light bulb to allow electricity to flow; and
a central contact being mounted coaxially on the bottom of the recess and abutting the distal end of the central contact of the bottom of the base of the corresponding B-typed light bulb to allow electricity to flow;
wherein the thread pitches of the threads on the base of the bulb of each A-typed light bulb and in the recess of the A-typed socket are larger than the thread pitches of the threads on the base of the bulb of each B-typed light bulb and in the recess of the B-typed socket.

5. A string of light comprising:
a string;
multiple A-typed light bulbs and each A-typed light bulb having
a bulb having
a bottom;
an inner chamber
illumination elements mounted in the inner chamber; and
a base being attached to the bottom of the bulb and having
an outer surface being cylindrical and conductive and being an electrical contact for the light bulb;
a bottom;
a thread being formed on the outer surface of the base and having a thread pitch; and
a central contact being formed coaxially on and protruding from the bottom of the base and having a length and a distal end;
multiple A-typed sockets mounted on the string, exclusively holding the A-typed light bulbs and each A-typed socket having
a recess being cylindrical, holding a corresponding A-typed light bulb and having
an open top;
a closed bottom;
an inner sidewall; and
a thread being formed on the inner sidewall of the recess, having a thread pitch and corresponding to the thread on the outer surface of the base of the corresponding A-typed light bulb;
a resilient contact being mounted longitudinally on the inner sidewall and abutting the outer surface of the base of the corresponding A-typed light bulb to allow electricity to flow; and
a central contact being mounted coaxially on the bottom of the recess and abutting the distal end of the central contact of the bottom of the base of the corresponding A-typed light bulb to allow electricity to flow;
multiple B-typed light bulbs and each B-typed light bulb having
a bulb having
a bottom;
an inner chamber
illumination elements mounted in the inner chamber; and
a base being attached to the bottom of the bulb and having
an outer surface being cylindrical and conductive and being an electrical contact for the light bulb;
a bottom;
a thread being formed on the outer surface of the base and having a thread pitch; and
a central contact being formed coaxially on and protruding from the bottom of the base and having a length and a distal end;
multiple B-typed sockets mounted on the string, exclusively holding the B-typed light bulbs and each B-typed socket having
a recess being cylindrical, holding a corresponding B-typed light bulb and having
an open top;
a closed bottom;
an inner sidewall; and
a thread being formed on the inner sidewall of the recess, having a thread pitch and corresponding to the thread on the outer surface of the base of the corresponding B-typed light bulb;
a resilient contact being mounted longitudinally on the inner sidewall and abutting the outer surface of the base of the corresponding B-typed light bulb to allow electricity to flow; and
a central contact being mounted coaxially on the bottom of the recess and abutting the distal end of the central contact of the bottom of the base of the corresponding B-typed light bulb to allow electricity to flow;
wherein the base of each A-typed light bulb further has a dimension; the recess of each A-typed socket further has a dimension corresponding to the dimension of the base of the A-typed light bulb; the base of each B-typed light bulb further has a dimension being different from the dimension of the base of each A-typed light bulb; and the recess of each B-typed socket further has a dimension corresponding the dimension of the base of each B-typed light bulb and being different from the dimension of the recess of each A-typed socket.

6. The string of light as claimed in claim 5, wherein the dimension of the base of the bulb of each A-typed light bulb and the dimension in the recess of each A-typed socket are larger than the dimension of the base of the bulb of each B-typed light bulb and the dimension the recess of each B-typed socket.

7. The string of light as claimed in claim 5, wherein the dimension of the base of the bulb of each A-typed light bulb and the dimension in the recess of each A-typed socket are smaller than the dimension of the base of the bulb of each B-typed light bulb and the dimension the recess of each B-typed socket.

* * * * *